US011045854B2

(12) United States Patent
Rosario

(10) Patent No.: US 11,045,854 B2
(45) Date of Patent: Jun. 29, 2021

(54) AUTOMATED METHOD AND MACHINE FOR FABRICATING METAL FENCE PICKETS

(71) Applicant: Harry Rosario, Fort Worth, TX (US)

(72) Inventor: Harry Rosario, Fort Worth, TX (US)

( * ) Notice: Subject to any disclaimer, the term of this patent is extended or adjusted under 35 U.S.C. 154(b) by 650 days.

(21) Appl. No.: 15/190,552

(22) Filed: Jun. 23, 2016

(65) Prior Publication Data

US 2017/0368587 A1 Dec. 28, 2017

(51) Int. Cl.

| | |
|---|---|
| ***B21D 5/00*** | (2006.01) |
| ***B21D 47/01*** | (2006.01) |
| ***B21D 28/32*** | (2006.01) |
| ***B21D 43/00*** | (2006.01) |
| ***B21D 35/00*** | (2006.01) |

(52) U.S. Cl.

CPC ..... *B21D 5/004* (2013.01); *B21D 28/32* (2013.01); *B21D 35/001* (2013.01); *B21D 43/006* (2013.01); *B21D 47/01* (2013.01)

(58) Field of Classification Search

CPC ..... B21D 5/001; B21D 35/001; B21D 28/32; B21D 43/006; B21D 47/01; B21D 21/00; B21D 13/08; B21D 13/10; B21D 5/004; B21F 29/02

See application file for complete search history.

(56) References Cited

U.S. PATENT DOCUMENTS

| | | | | | |
|---|---|---|---|---|---|
| 4,027,517 | A * | 6/1977 | Bodnar | B21D 13/08 | 72/177 |
| 4,362,039 | A * | 12/1982 | Toti | B21D 53/00 | 72/186 |
| 4,499,938 | A * | 2/1985 | Toti | B21D 13/04 | 160/236 |
| 4,934,224 | A * | 6/1990 | Brown | B21C 37/02 | 72/132 |
| 5,040,397 | A * | 8/1991 | Bodnar | B21D 28/36 | 72/190 |
| 5,305,625 | A * | 4/1994 | Heinz | B21D 9/125 | 72/129 |
| 5,433,097 | A * | 7/1995 | Nord | B21D 5/02 | 72/19.8 |
| 9,283,604 | B2 * | 3/2016 | Baum, Jr. | B21D 5/08 | |
| 2012/0323354 | A1 * | 12/2012 | Anderson | B21D 5/08 | 700/108 |

* cited by examiner

*Primary Examiner* — Teresa M Ekiert

(57) ABSTRACT

An automated method and machine for fabricating metal fence pickets in a single operation includes forming material, typically metal strip into multiple pickets with various shapes. The machine includes automated programmable machine for inserting raw material to form the metal fence pickets, automated programmable machine for embossing the metal fence pickets, automated programmable conveyor machine for conveying the raw material, automated programmable machine for cutting, punching holes, and folding the raw material to form the metal fence pickets.

2 Claims, 3 Drawing Sheets

AUTOMATED METHOD AND MACHINE FOR FABRICATING METAL FENCE PICKETS

BACKGROUND OF THE INVENTION

The present invention relates to fabricating metal fence pickets. More particularly, the invention relates to an automated process and machine for progressively and continuously rolling and folding material to fabricate metal fence pickets in one operation.

SUMMARY OF THE INVENTION

This invention relates to an automated method and roll forming machine for fabricating multiple metal fence pickets, a technology of progressively and continuously folding material by means of successive pairs of profiled rolls, the rolls in each pair being described as roll segments. The roll segments are also known as stages, stands or passes. In use, raw material is automatically fed form a de-coiler into the roll forming machine at one end between the pairs of roll segments, and is progressively folded by the successive pairs of roll segments in a series of discrete steps to emerge at the other end of the machine formed about the feed axis. The roll segments in the pairs may both form and drive the raw material through the machine. The material most commonly formed is metal, but non-ferrous metals and other materials are also considerably formed by this method.

In a preferred embodiment of the present invention, the method comprises the steps of inserting raw material from a de-coiler to an embossing machine to emboss wooden or other decorative textures on the raw material, transferring the embossed raw material to a first cutting station which includes a hydraulic-driven unit capable of cutting the raw material, cutting upper portion for each metal fence picket, transferring the cut raw material to a punching hole station which includes a hydraulic-driven unit capable of punching multiple holes on the raw material, punching multiple holes on the raw material, transferring the punched raw material to a roll forming station for folding edges of the raw material for each metal fence picket, engraving at least one set or one pair of vertical lines on the raw material for each metal fence picket, transferring the formed raw material to a second cutting station which includes a hydraulic-driven unit capable of cutting the raw material, cutting the length of the raw material for each metal fence picket.

In another preferred embodiment, the present invention provides an automated machine for fabricating metal fence pickets. The machine comprises an automated programmable de-coiler for inserting the raw material into the embossing station, automated programmable means for embossing the raw material, automated programmable table run-out and multiple slideable roll segments that are mounted on a shaft carrying the roll segments for transferring the raw material, an automated programmable first cutting station for cutting the upper portion of each metal fence picket, automated programmable means for cutting the raw material, an automated programmable punching station for punching multiple holes on the raw material for each metal fence picket, automated programmable means for punching holes on the raw material, automated programmable table run-out and multiple slideable roll segments that are mounted on a shaft carrying the roll segments for transferring the raw material and fold double edges vertically on the raw material for each metal fence picket, automated programmable means for folding double edges on the raw material, automated programmable means for engraving lines vertically on the raw material for reinforcement rips for each metal fence picket, automated programmable table run-out conveyor for conveying the raw material to the second cutting station, an automated programmable second cutting station for cutting the length of the raw material for each metal fence picket.

In another preferred embodiment, the present invention utilizes a table run-out conveyor to automatedly transfer the raw material.

In another preferred embodiment, the present invention utilizes the table run-out conveyor and double roll segments that are mounted on a shaft carrying the double roll segments fold double edges along x-axis on the raw material for each metal fence picket.

In another preferred embodiment, the present invention utilizes the table run-out conveyor and slideable roll segments that are mounted on a shaft carrying the slideable roll segments to automatedly transfer the raw material and engrave vertical lines on the raw material for reinforcement ribs for each metal fence picket, In another preferred embodiment of the invention, the roll segments can be adjusted to fabricate different sizes of the metal fence pickets preferably 4", 5" and 6" in width.

In another preferred embodiment of the invention, the punching and cutting stations of the top of picket include at least one limit switch sensor to guide precise hole and cutting position.

In another preferred embodiment of the invention, the roll segments engrave the multiple vertical lines for reinforcement ribs to add strength to the metal on the vertical plan.

In another preferred embodiment of the invention, an encoder is attached to the roll forming machine and operatively connected to the computer console to receive predetermined parameters of number of pickets to be produced, length, position of screw holes.

In another preferred embodiment of the invention, the roll forming machine is operated by a servo motor that can optimize speed and precision as well as automatically adjust speed to synchronize with the de-coiler and embossing station individual motors.

In another preferred embodiment of the invention, the automated machine includes a control unit programmable to set dimensional parameters and process signals from the sensors.

Further objects and advantages of the present invention will become apparent from a description of the several embodiments as set forth in the following description and drawings.

BRIEF DESCRIPTION OF DRAWINGS

Referring now to the drawings in which like reference numbers represent corresponding parts throughout.

DETAILED DESCRIPTION OF THE INVENTION

The following description includes the best mode presently contemplated for carrying out the invention. This description is not to be taken in a limiting sense, but is made merely for the purpose of describing the general principles of the invention. The scope of the invention should be determined with reference to the claims. References are made to FIGS. 1-3, the method and automate machinery system for fabricating metal fence pickets according to a preferred embodiment of the present invention.

Figure 1:
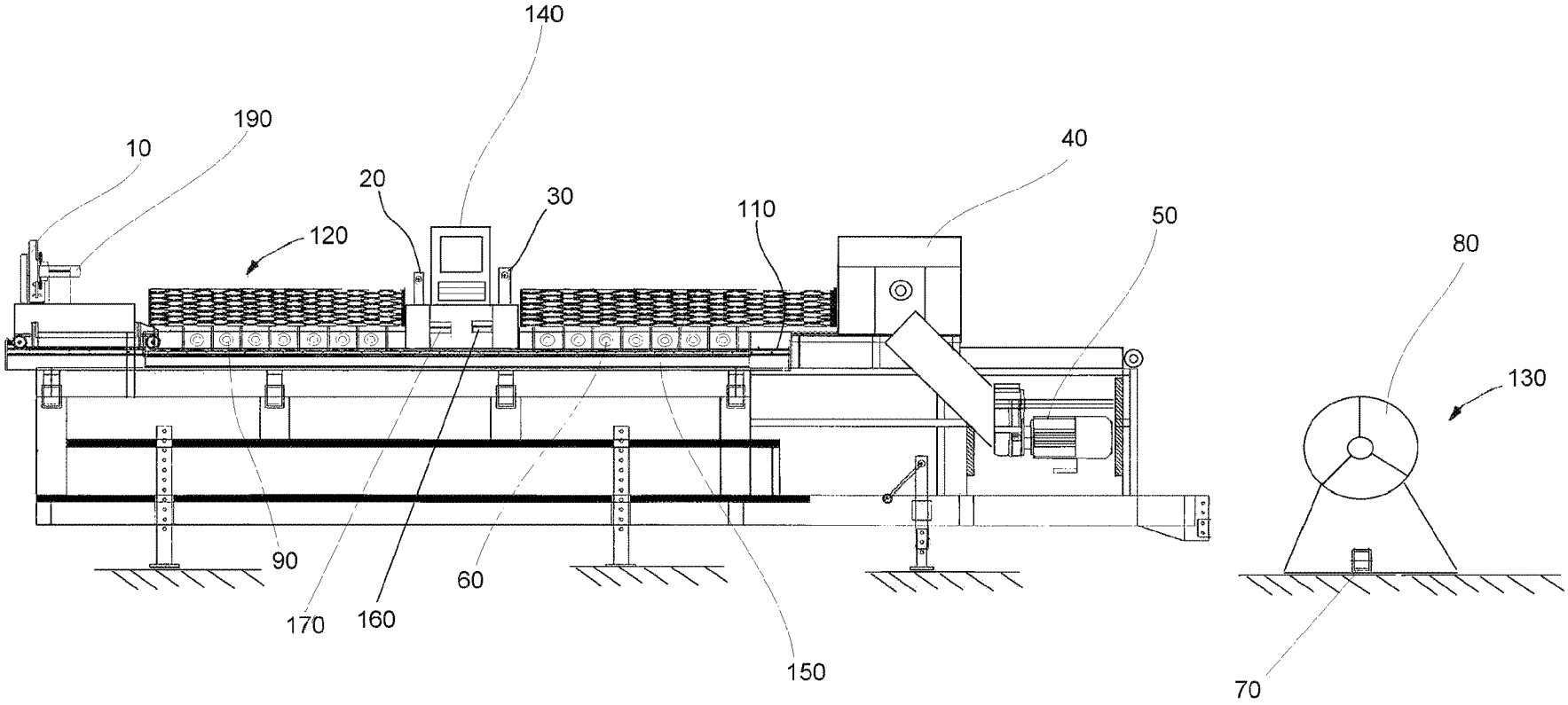
FIG. 1 is an assembled side view of the automated machine for fabricating metal fence pickets according to a preferred embodiment of the present invention.

The machine 100 comprises a de-coiler 130 having a rotary wheel 80 for the raw material and a speed sensor 70 for sensing the speed of the de-coiler 130, wherein the sensor 70 is connected to computer console 140 to adjust feeding raw material to embossing station 40 as shown in FIG. 1.

Figure 2B:
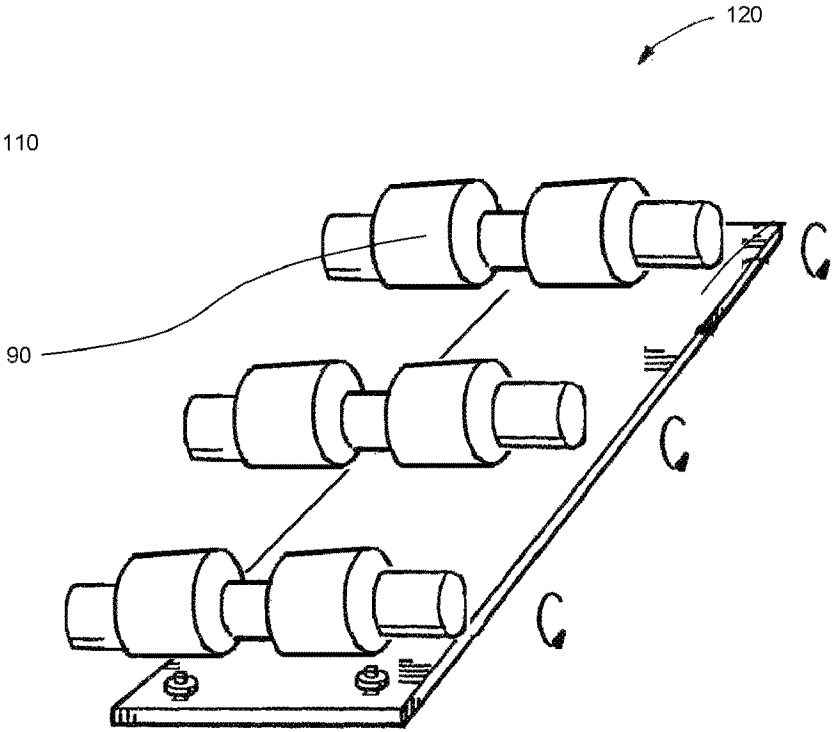
FIG. 2B is a perspective view of table run-out conveyor and metal folding roll segments.
Figure 2A:
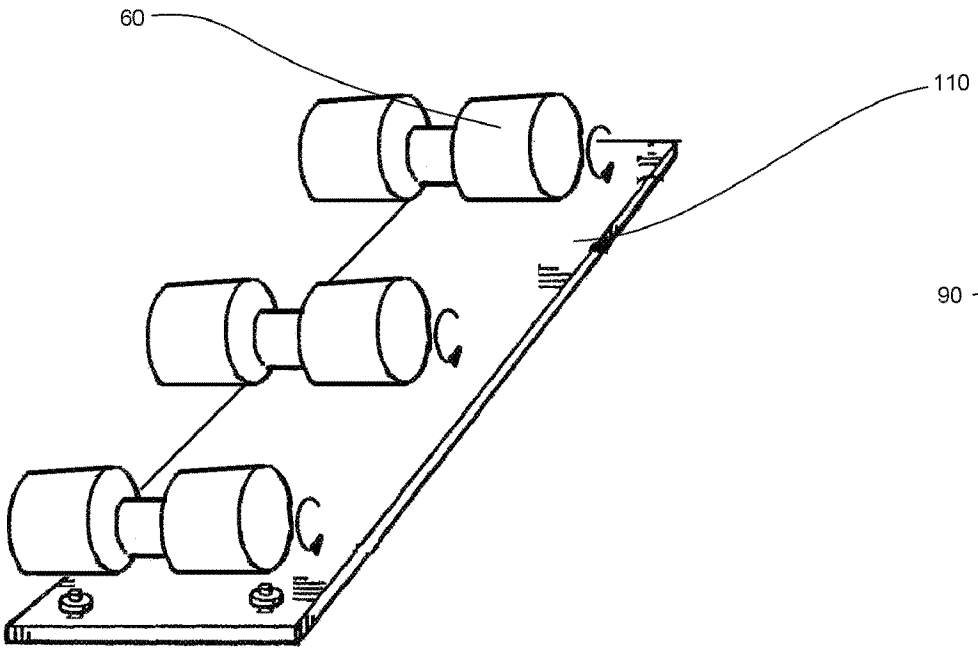
FIG. 2A is a perspective view of table run-out conveyor and slideable roll segments.

Referred to FIGS. 1-2A, the table run-out conveyor 110 is mounted on a main frame 150 which has slideable roll segments 60 to transfer embossed raw material first cutting station 30, wherein the first cutting station 30 is actuated by hydraulic power 180 and has a cutting guide sensor 160 connected to computer console 140 to position the cutting mechanism along the x-axis of the cutting area on the raw material for the upper portion of the metal fence pickets. The main frame 150 is operated by motor 50, wherein the motor 50 is a servo motor which is automatically adjustable to synch with the embossing station and de-coiler speeds.

As shown best in FIGS. 1-2B, the punching station 20 is actuated by hydraulic power 180 having a punching guide sensor 170 connected to computer console 140 to position the punching mechanism along the x-axis of the punching area on the raw material for the screw holes. Roll forming station 120 is attached to the end of the linear table run-out conveyor to continue transferring the raw material to the roll forming station 120 which includes double roll segments 90, wherein the double roll segments 90 fold double edges and engrave lines along x-axis on the raw material for each metal fence picket.

The guide sensor 190 is attached to the second cutting station 10 and connected to the computer console 140 to position the cutting mechanism on the cutting area on the raw material which runs the length of the each metal fence picket.

The computer console 140 is used to display and set operational parameters for operating the cutting and punching mechanisms, wherein the computer console 140 is any type of industrial computer with processor and hard drive to include a programmable logic controller or personal computer. The computer console 140 processes software that controls the feeding, cutting, and punching processes and interfaces to a typical laptop or other portable computer to receive programming instructions. The laptop or other portable computer also includes a wireless card to receive programming software via a wireless network.

Figure 3:
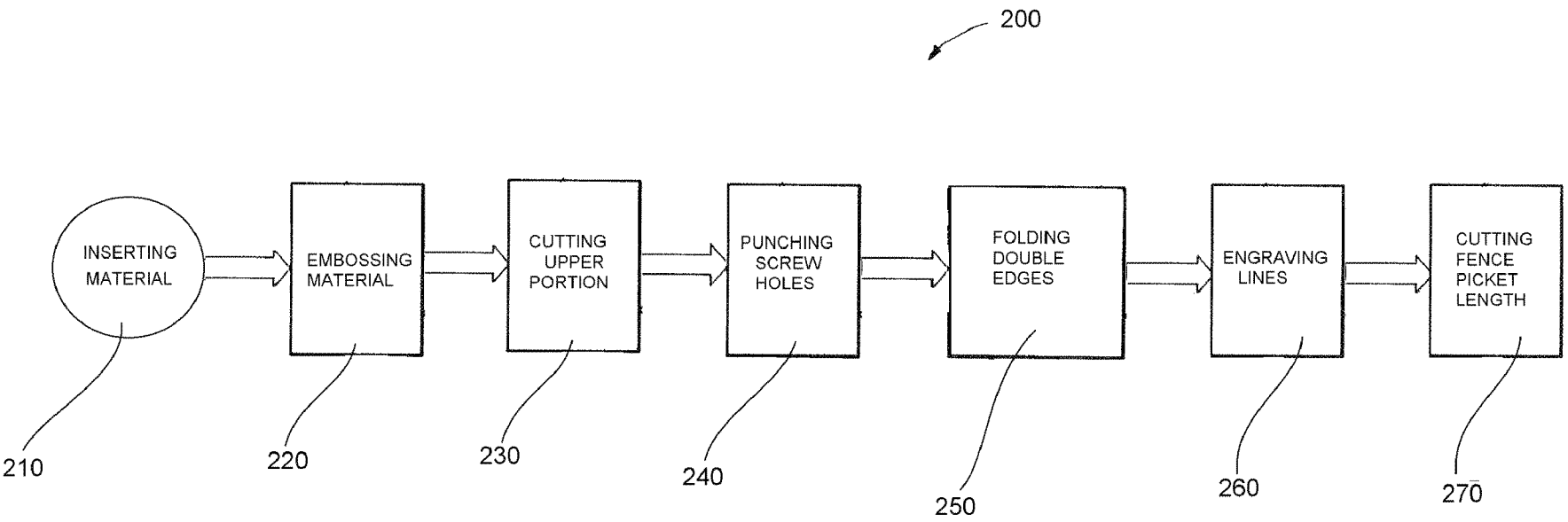
FIG. 3 is a diagram of the method for fabricating metal fence pickets according to a preferred embodiment of the present invention.

Referring to FIG. 3, and with reference to the machine 100 in FIG. 1, the present method 200 begins with step 210, wherein a first machine operation is begin to perform. At step 210, at step 210, raw material is fed into the machine by the de-coiler 130 for processing. Once the embossing station 40 receives the raw material, the method 200 proceeds step 220 to emboss the raw material.

At step 230 reference to FIG. 2A, the embossed raw material is transferred to the first cutting station 30 by the table run-out conveyor 110 and slideable roll segments 60, wherein the embossed raw material is cut for the upper portion of the metal fence pickets.

At step 240, the punching station 20 is operable to punch screw holes positioned by the punching guide sensor 170 on the raw material.

At steps 250 and 260 reference in FIG. 2B, the raw material is transferred to the folding station 120 for double edges fold and enforcement ribs.

At step 270 reference to the machine 100 in FIG. 1, the raw material is transferred to the second cutting station 10 for cutting length for each metal fence picket.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. An automated machine for fabricating a plurality of metal fence pickets comprising:

a de-coiler having a rotary wheel, wherein the de-coiler is actuated by a linear motor being driven electronically;

an embossing machine for creating decorative textures on a raw material provided by the de-coiler, wherein the raw material is selected from the group consisting of metal, non-ferrous metal, and other materials;

at least one speed sensor positioned with respect to the de-coiler;

a roll forming station having a plurality of slidable double roll segments mounted on a shaft for folding double edges vertically of the raw material and for engraving vertical lines on the raw material, wherein each roll segment is adjustable to fabricate different sizes of the raw material selected from the group consisting of 4", 5" and 6" in width;

a first cutting station for cutting an upper portion of the raw material, wherein the first cutting station further comprises at least one limit switch sensor;

a table run-out conveyor mounted on a main frame;

a motor to operate the main frame, wherein the motor is a servo motor, and wherein the servo motor is automatically adjustable to synch with the embossing machine and the de-coiler speeds;

a programmable punching station having a punching mechanism for punching a plurality of holes on the raw material horizontally, wherein the programmable punching station further comprises a sensor;

a second cutting station for cutting a length of the raw material to form the metal fence picket, wherein the second cutting station comprises a second sensor;

a computer console connected to the at least one speed sensor for controlling the speed of the de-coiler, wherein the de-coiler rotates at a slower speed while the embossing machine is embossing, and a faster speed for conveying the raw material to the embossing machine and away from the embossing machine after the raw material has been embossed; and an encoder attached to the roll forming station and the computer console for determining a number of the plurality of the metal fence pickets to be formed and a length for each of the metal fence pickets.

2. The automated machine according to claim 1, wherein the embossing machine is actuated by a linear motor being driven electronically.

* * * * *